US006801108B2

(12) United States Patent
Wang et al.

(10) Patent No.: US 6,801,108 B2
(45) Date of Patent: Oct. 5, 2004

(54) MILLIMETER-WAVE PASSIVE FET SWITCH USING IMPEDANCE TRANSFORMATION NETWORKS

(75) Inventors: Huei Wang, Taipei (TW); Yu-Jiu Wang, Taichung Hsien (TW); Kun-You Lin, Taipei Hsien (TW)

(73) Assignee: Taiwan University, Taipei (TW)

( * ) Notice: Subject to any disclaimer, the term of this patent is extended or adjusted under 35 U.S.C. 154(b) by 3 days.

(21) Appl. No.: 10/014,600

(22) Filed: Dec. 14, 2001

(65) Prior Publication Data

US 2003/0112102 A1 Jun. 19, 2003

(51) Int. Cl.[7] ..... H01P 1/10
(52) U.S. Cl. ..... 333/262; 333/104; 333/246
(58) Field of Search ..... 333/104, 262, 333/103, 32–35, 138–140, 156–164, 246

(56) References Cited

U.S. PATENT DOCUMENTS 3,662,294 A * 5/1972 Jacobs et al. ..... 333/33
3,965,445 A * 6/1976 Ou ..... 333/33
5,012,123 A * 4/1991 Ayasli et al. ..... 307/112
5,485,130 A * 1/1996 Nakahara et al. ..... 333/104
5,563,551 A * 10/1996 Kashiwa ..... 330/277
5,786,737 A * 7/1998 Goto ..... 333/33
6,054,907 A * 4/2000 Sjogren ..... 333/161

OTHER PUBLICATIONS

Howard Stone "Resonace" Web pp. 1–3 Jan. 25, 1997.*

* cited by examiner

*Primary Examiner*—Robert Pascal
*Assistant Examiner*—Kimberly Glenn
(74) *Attorney, Agent, or Firm*—Bacon & Thomas, PLLC

(57) ABSTRACT

The present invention provides a millimeter-wave passive FET switch by using impedance transformation network to transfer the effective capacitance seen from the drain to source of an FET at off-state to low impedance, while transfer low impedance seen at on-state to high impedance. Since both on-state and off-state are transferred to high impedance, and low impedance respectively, a high-performance switch can be achieved. Since the size of the transformation network is small, the performance of the switch can be promoted with low cost.

1 Claim, 3 Drawing Sheets

MILLIMETER-WAVE PASSIVE FET SWITCH USING IMPEDANCE TRANSFORMATION NETWORKS

FIELD OF THE INVENTION

The present invention relates to a signal switch network, in particular, a millimeter-wave passive FET (Field Effect Transistor) switch using impedance transformation networks.

BACKGROUND OF THE INVENTION

High frequency switch is one of the important devices in MMW (millimeter-wave) radio communication system. The performance of a circuit is limited by the devices used in the circuit. As to the high frequency switch used in millimeter-wave band, the isolation, of the switch in on/off state is limited by the FET used in the switch. Since in high frequency, an FET in off state will present low impedance instead of high impedance due to the capacitance between the drain and source of the FET. In addition, high frequency signals between neighbor transmission lines will often couple with one another so as to degrade the performance of the circuit.

Monolithic PIN diode microwave switch has demonstrated excellent performance even up to millimeter-wave frequency. However, since PIN diode cannot be manufactured in MMIC (Monolithic Microwave Integrated Circuit) process of HEMT (High Electron Mobility Transistor, one type of FET), FET switch is still very popular today, because FET can be integrated with other building blocks in a transmit/receive (T/R) module, and presents better linearity than PIN diode. For frequency of 20 GHz or lower, series and/or shunt configurations of an FET with a transmission line can readily serve as a very good switch with excellent isolation and insertion loss. However, for frequency higher than 20 GHz, the parasitic capacitance between the drain and the source of FET will degrade the, isolation performance significantly. Most MMW monolithic FET switches employ indutors to resonate with the parasitic capacitance between the drain and the source of FET, but the isolation of the swich is still lower than 30 dB (please see references [1]~[4]).

In order to enhance the isolation of the switch, a transmission line with quarter wavelength is used to increase the distance between the switch and the signal line, so as to achieve up to 44 dB isolation (please see reference [5]), but a huge chip area is required, and therefore increase the cost.

Phase cancellation technique, of Lange coupler can also be used to achieve a better isolation performance (please see reference [6]), but several 3 dB and 90° Lange couplers are required, and thus increase the layout area.

Recently, compact DC~60 GHz HJFET MMIC switch was reported with reasonable isolation performance (please see references [7]~[8]), but a special process/layout for the ohmic electrode sharing technology is required in HEMT devices.

REFERENCES

[1] M. J. Schindler and A. Morris, "DC-40 Gz and 20–40 GHz MMIC SPDT switches," *IEEE Trans. on Microwave Theory Tech.*, vol. MTT-35, no. 12, pp. 1486–1493, December 1987.

[2] P. Bermkopf, M. Schindler, and A. Bertrand, "A high power K/Ka-band monolithic T/R switch," in 1991 *IEEE Microwave & Millimeter-wave Monolithic Circuits Symposium Digest*, pp. 15–8, June 1991.

[3] G. L. Lan, D. L. Dunn, J. C. Chen, C. K. Pao and D.C. Wang. "A high performance V-Band monolithic FET transmit-receive switch," in 1988 *IEEE Microwave & Millimeter-wave Monolithic Circuits Symposium Digest*, pp. 99–101, June 1988.

[4] M. Aust, H. Wang, R. Carandang, K. Tan, C. H, Chen, T. Trinh, R. Esfandiari and H. C. Yen, "GaAs monolithic components development for Q-Band phased array application," in 1992 *IEEE MTT-S International Microwave Symposium Digest*, vol. 2, pp.703–706, June 1991.

[5] D. L. Ingram, K. Cha, K. Hubbard, and R. Lai, "Q-band high isolation GaAs HEMT switches," in 1996 *IEEE GaAs IC Symp. Dig.*, Orlando, Fla., pp. 289–282, November 1996.

[6] D.C. W. Lo, H. Wang, Barry R. Allen, G. S. Dow, Kwo Wei Chang, Michael Biedenbender, Richard Lai, Sian Chen, Daniel Yang, "Novel monolithic multifunctional balanced switching low-noise amplifiers," *IEEE Trans, on Microwave Theory and Tech.*, vol. 42, no. 12, pp 2629–2634, November 1998.

[7] H. Mizutani, N. Funabashi, M. Kuzuhara, Y. Takayama, "Compact DC-60-GHz HJFET MMIC switches using ohmic electrode-sharing technology," *IEEE Trans. on Microwave Theory and Tech.*, vol. 46, no. 11, pp. 1597–1603, November 1998.

[8] Kenichi Maruhashi, Hiroshi Mizutani, Keiichi Ohata, "Design and performance of a Ka-band monolithic phase shifter utilizing nonresonant FET switches," *IEEE Trans on Microwave Theory and tech.*, vol. 48, no. 8, pp. 1313–1317, August 2000.

[9] Yu-Jiu Wang, Kun-You Lin, Dow-Chih Niu, and Huei Wang, "A V-band MMIC SPDT passive HEMT switch using impedance transformation networks," in 2001 *IEEE MTT-S International Microwave Symposium Digest.*, Phoenix, vol. 1, pp. 253–256, May, 2001.

OBJECT OF THE INVENTION

It is therefore an object of the present invention to provide a millimeter-wave passive FET switch using impedance transformation networks, utilizing the standard HEMT manufacturing process to reduce the layout of the chip, and to enhance the performance of the high frequency switch.

DESCRIPTION OF THE INVENTION

Conventionally a microwave switch is designed by adding an FET or a diode series/shunt connected with the signal lines. The impedance of the FET/diode is controlled by voltage so as to achieve open/short function of the switch.

Figure 1A:
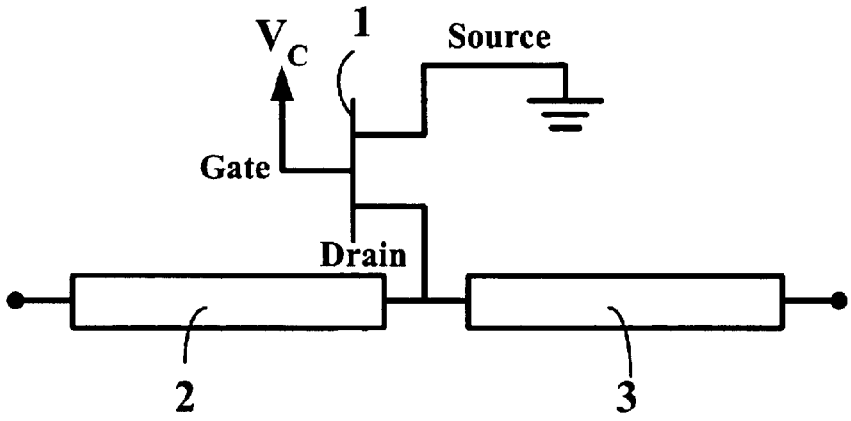
Fig. 1(a) (PRIOR ART)
FIG. 1 shows schematically the network of a conventional millimeter-wave switch.
Figure 1B:
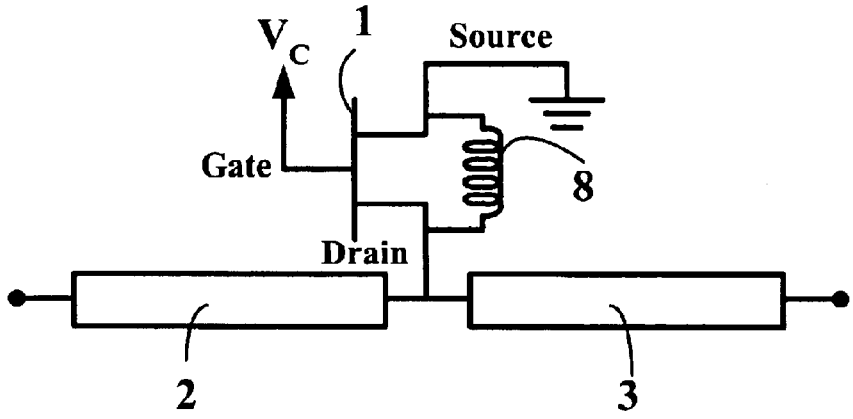
Fig. 1(b) (PRIOR ART)

Referring to FIG. 1, an FET T1 is shunt connected with the signal line SL, in which the gate G of the FET T1 is connected with a control voltage V to control the impedance between the drain D and the source S of FET T1. The drain D and the source S are connected parallelly with the signal line SL and to the ground.

For lower frequencies, since FET T1 demonstrates excellent performance, the shunt connection has no problem at all. However, for MMW frequencies, when the voltage V tries to change the FET T1 into open circuit, since the parasitic capacitance between the drain D and the source S causes FET T1 to present low impedance instead of high impedance, therefore the isolation performance of the passive FET is degraded significantly.

Figure 2:
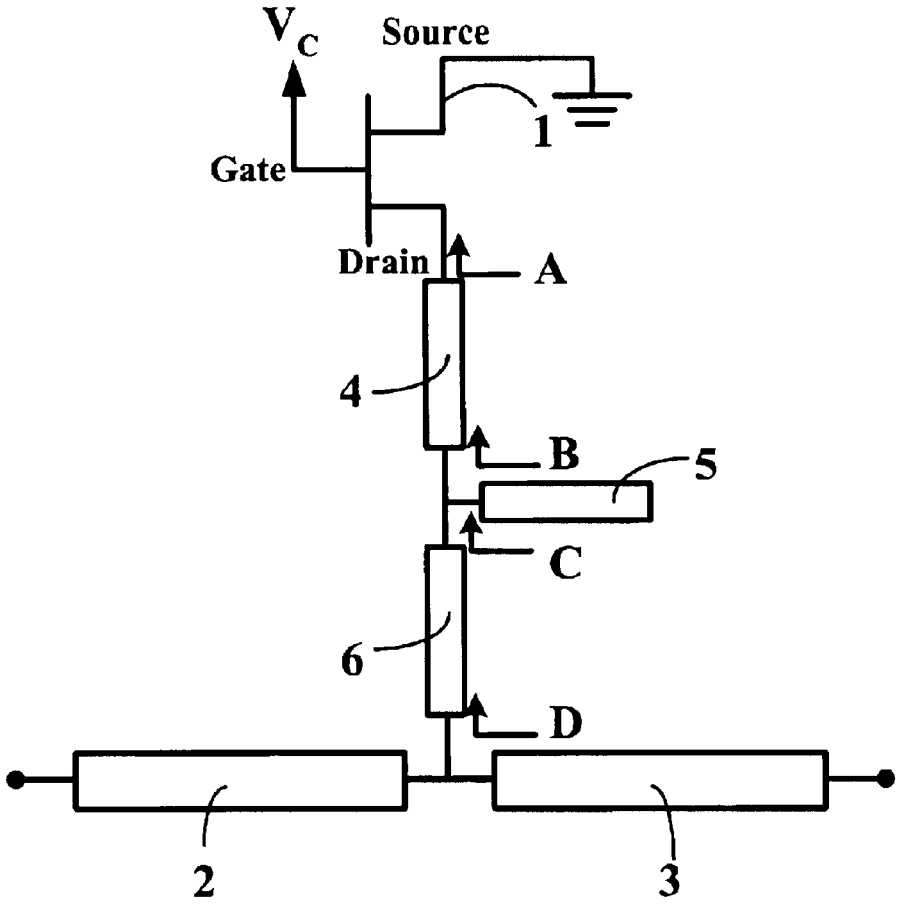
FIG. 2 shows schematically the network of the millimeter-wave switch according to the present invention by adding impedance transformation network.

In order to enhance the performance of the switch, the present invention employs impedance transformation networks to be parallelly connected with the signal line SL, as shown in FIG. 2. The equivalent impedance seen at point A is A(on), A(off) as shown in the Smith Chart of FIG. 3. There is no impedance transformation network added, as the same configuration in FIG. 1.

Figure 3:
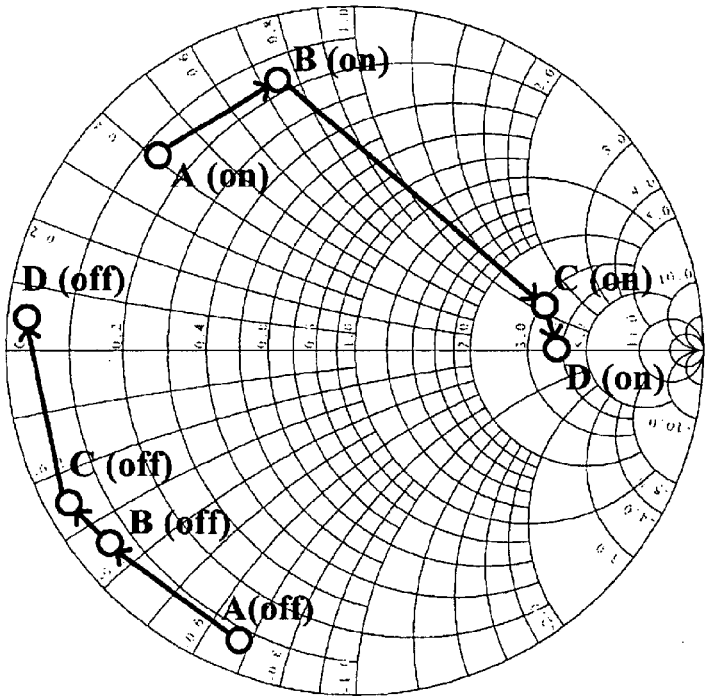
FIG. 3 shows schematically the impedance transformation in Smith Chart of the millimeter-wave switch according to the present invention.

First, a first transmission line Step 1 is series connected with the FET T1, the equivalent impedance seen at point B is B(on), B(off) as shown in the Smith Chad of FIG. 3.

Next, a second transmission line Step 2 is parallelly connected, the equivalent impedance seen at point C is C(on), C(off) as shown in the Smith Chart of FIG. 3.

Finally, a third transmission line Step 3 is series connected, the equivalent impedance seen at point D is D(on), D(off) as shown in the Smith Chart of FIG. 3.

By the three steps of impedance transformation, it is apparent that the equivalent impedance seen from the signal line SL is transferred from A(on), A(off) to D(on), D(off) in the Smith Chart of FIG. 3. This proves that an excellent switching performance is achieved by adding the impedance transformation networks to the FET T1. It is noted that point D(on) represents a high impedance (near open circuit), while D(off) is a low impedance (near short circuit).

Figure 4:
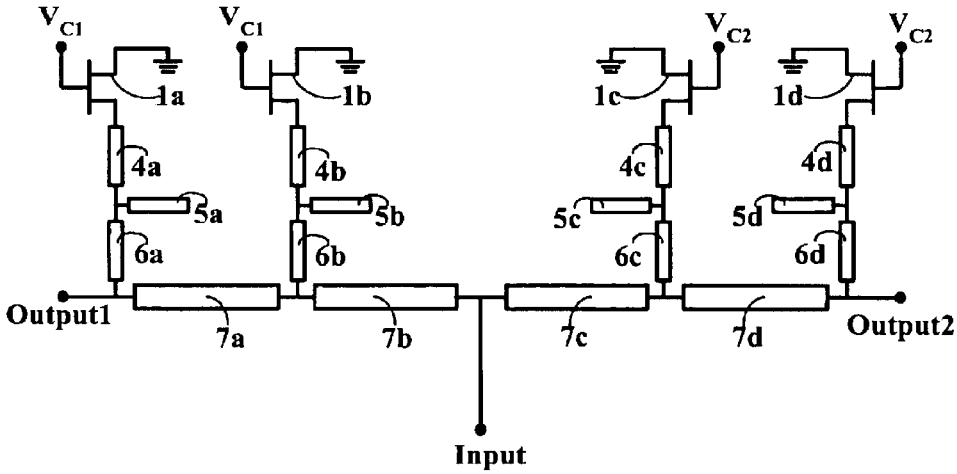
FIG. 4 shows schematically a complete single pole double through (SPDT) millimeter-wave switch according to the present invention.

A complete single pole double through (SPDT) switch is shown in FIG. 4.

Two monolithic microwave switch ICs are manufactured successfully according to the present invention, and it demonstrates excellent switching performance, while the size thereof is only 1×2 $mm^2$ (please see reference [9]), much smaller than the conventional size of 2×5 $mm^2$ (please see reference [5]).

The connection of impedance transformation networks Step 1, Step 2, Step 3 with FET T1 in FIG. 2 can be series connected with the signal line SL instead of parallel connected.

The spirit and scope of the present invention depend only upon the following claims, and are not limited by the above embodiments.

What is claimed is:

1. A millimeter-wave passive FET switch, comprising a signal line, an FET, an impedance transformation network, wherein:

a gate of said FET is connected with a voltage for controlling the impedance between a drain and a source of said FET, said drain and said source are series connected with said impedance transformation network, and then parallel connected or series connected with said signal line, there is no reactance component connected between said drain and said source of said FET, an equivalent impedance of said switch contains no reactance; and said impedance transformation network is designed to make the off-state effective high capacitance of said FET in high frequency become low impedance, while the on-state low impedance of said FET in high frequency becomes high impedance.

* * * * *